US005123969A

United States Patent [19]

Chou

[11] Patent Number: 5,123,969

[45] Date of Patent: Jun. 23, 1992

[54] BAKE-HARDENING COLD-ROLLED STEEL SHEET HAVING DUAL-PHASE STRUCTURE AND PROCESS FOR MANUFACTURING IT

[75] Inventor: Tung-Sheng Chou, Kaohsiung, Taiwan

[73] Assignee: China Steel Corp. Ltd., Taiwan

[21] Appl. No.: 648,937

[22] Filed: Feb. 1, 1991

[51] Int. Cl.[5] ..... C21D 8/00

[52] U.S. Cl. ..... 148/547; 148/330; 148/328; 148/602; 148/623

[58] Field of Search ..... 148/2, 12 F, 12 R, 12.4, 148/12.3, 330, 320, 328

[56] References Cited

U.S. PATENT DOCUMENTS

| | | | |
|---|---|---|---|
| 3,947,293 | 3/1976 | Takechi et al. | 148/12 F |
| 4,040,873 | 8/1977 | Nakaoka et al. | 148/12.3 |
| 4,336,080 | 6/1982 | Nakaoka et al. | 148/12 F |

FOREIGN PATENT DOCUMENTS 0056528 4/1984 Japan .

*Primary Examiner*—R. Dean
*Assistant Examiner*—Sikyin Ip
*Attorney, Agent, or Firm*—Sughrue, Mion, Zinn, Macpeak & Seas

[57] ABSTRACT

A bake hardening cold-rolled steel sheet which has good bake hardenability, good dent resistance, and low yield ratio which contributes to the shape-fixability of the steel sheet. The steel is suitable for the outer panel of an automobile. The process for manufacturing the steel sheets includes the following steps:

(1) preparing a melting steel which contains 0.02 to 0.06% carbon by weight, 0.60% to 1.40% manganese by weight, 0.5% silicon by weight at most, 0.1% phosphorus by weight at most, 0.1% aluminum by weight at most, 0.01% nitrogen by weight at most, 0.1% titanium by weight at most, and 50 ppm of boron at most;

(2) preparing steel ingots by continuous casting the melting steel;

(3) hot rolling the steel ingots to hot-rolled bands;

(4) coiling the hot-rolled bands at temperature ranging from 560° C. to 720° C.;

(5) after cold rolling, soaking the steel sheets at temperature ranging from 780° C. to 900° C. for less than five minutes to proceed intercritical (ferrite plus austenite) annealing treatment;

(6) gradually cooling the steel sheets in the air to temperature ranging from 650° C. to 750° C.; and (7) cooling the steel sheets to temperature ranging from 200° C. to 400° C. by roller-quenching at the cooling rate ranging from 50° C./sec to 400° C./sec to proceed overageing treatment for a time duration ranging from 1 minute to 6 minutes.

2 Claims, 5 Drawing Sheets

BAKE-HARDENING COLD-ROLLED STEEL SHEET HAVING DUAL-PHASE STRUCTURE AND PROCESS FOR MANUFACTURING IT

BACKGROUND OF THE INVENTION

The present invention relates generally to a bake hardening cold-rolled steel sheet. The steel sheet has good baking hardenability, good dent resistance, and low yield ratio which contributes to the shape-fixability of the steel sheet. The present invention also relates a process for manufacturing the above steel sheet.

Recently, for the purpose of minimizing the fuel consumption, the thickness of the outer panel of a automobile has to be reduced. Thus, it is desirous of a high strength steel sheet capable of reducing the thickness of the outer panel of the automobile. Many kinds of high strength steels for this purpose, such as high strength low alloy steel, phosphorus added steel, dual-phase cold-rolled steel, and bake hardening steel have been suggested. However, the above-mentioned steels are unable to meet the requirements of this purpose.

The high strength low alloy steel is manufactured by adding a small amount of alloys into the matrix of the steel to increase the strength of the steel sheet and subsequently to reduce the required thickness of the steel sheet. However, the high strength low alloy steel is unable to be deformed without difficulty. In other words, the high strength low alloy steel has a poor shape fixability and thus, it is not suitable to be used as the outer panel of the automobile.

The rephosphorus steel is manufactured by adding phosphorus to the steel to elevate the drawability of the steel sheet. However, too much phosphorus will increase the yield strength of the steel sheet, and this will result in the increase of the spring back angle. This is, the shape-fixability of the steel sheet will get worse when too much phosphorus is added, and this will result in the increase of the flexibility of the steel. For this reason, rephosophrus steel is not suitable to be used as the outer panel of the automobile.

The dual-phase cold-rolled steel has a ferrite matrix with dispersed martensites therein, so that a good adjustment between the strength and the ductility of the steel sheet can be made, and the characteristics of high work hardening rate, low yield ratio, and continuous yielding can be obtained. However, the conventional dual-phase cold-rolled steel has poor baking hardenability.

The bake hardening steel having a ferrite matrix with cementites contained therein is manufactured by adding alloys and controlling the processes to obtain a steel containing a lot of carbon solid solutions which will contribute to the subsequent bake hardening of the steel sheet. However, a large amount of carbon solid solutions will easily cause yield point elongation during shape-forming of the steel sheet, and it will result in a poor outer appearance of the steel sheet. Thus, a large amount of cold-rolled temper extension is applied to eliminate the above-mentioned defects of the bake hardening steel. However, a large amount of solid solutions will cause room temperature ageing and cause the restoration of the yield point elongation.

SUMMARY OF THE INVENTION

The primary object of the present invention is to provide a bake hardening dual-phase cold-rolled steel sheet which has the advantage of both the dual-phase cold-rolled steel sheet and the bake hardening steel sheet. The second phase of the steel of this invention is the martensite which will induce free dislocation in the ferrite matrix during phase transformation to reduce the yield strength of the steel and to result in a continuous yielding character while in forming. Thus, even in the situation that many carbon solid solutions exist in the matrix of the steel, the phenomenon of yield point elongation of this kind of bake hardening steel will not occur. By this, the manufacturing process of the steel will be greatly simplified. Before treatment, the steel of this invention has a low yield strength like that of the mild steel. While in use, the steel has a good dent resistance, so that it is suitable to be used as an automobile panel which does not need the forming process of deep drawing. The bake hardening dual-phase cold-rolled steel sheet has a tensile strength of about 40 kgf/mm$^2$, a yield strength less than 24 kgf/mm$^2$, an elongation percentage larger than 35%, and a total increased strength larger than 8 kgf/mm$^2$ which are caused by work hardening and baking hardening. After shape-forming process and baking finish, the yield strength of the steel of this invention is elevated from a value less than 24 kgf/mm$^2$ to a value larger than 30 kgf/mm$^2$. Furthermore, the shape-formability and the dent resistance of the steel are enhanced.

It is another object of the present invention to provide a process for manufacturing a bake hardening dual-phase cold-rolled steel sheet which has a low yield ratio, a high tensile strength, a high ductility, good work hardenability and bake hardenability.

In accordance with the present invention, a process for manufacturing a baking hardening cold-rolled steel sheet, includes the following steps:

(1) preparing a melting steel which contains 0.02 to 0.06% carbon by weight, 0.60% to 1.40% manganese by weight, 0.5% silicon by weight at most, 0.1% phosphorus by weight at most, 0.1% aluminum by weight at most, 0.01% nitrogen by weight at most, 0.1% titanium by weight at most, and 50 ppm of boron at most;

(2) preparing steel ingots by continuous casting the melting steel;

(3) hot rolling the steel ingots to hot-rolled bands;

(4) coiling the hot-rolled bands at temperature ranging from 560° C. to 720° C.;

(5) after cold rolling, soaking the steel sheets at temperature ranging from 780° C. to 900° C. for less than five minutes to proceed intercritical (ferrite plus austenite) annealing treatment;

(6) gradually cooling the steel sheets in the air to temperature ranging from 650° C. to 75020 C.; and (7) cooling the steel sheets to temperature ranging from 200° C. to 400° C. by roller-quenching at the cooling rate ranging from 50° C./sec to 400° C./sec to proceed overageing treatment for a time duration ranging from 1 minute to 6 minutes.

BRIEF DESCRIPTION OF THE DRAWINGS

The present invention can be more fully understood by reference to the following description and accompanying drawings, such form an integral part of this application.

DETAILED DESCRIPTION OF THE PREFERRED EMBODIMENTS

Figure 1:
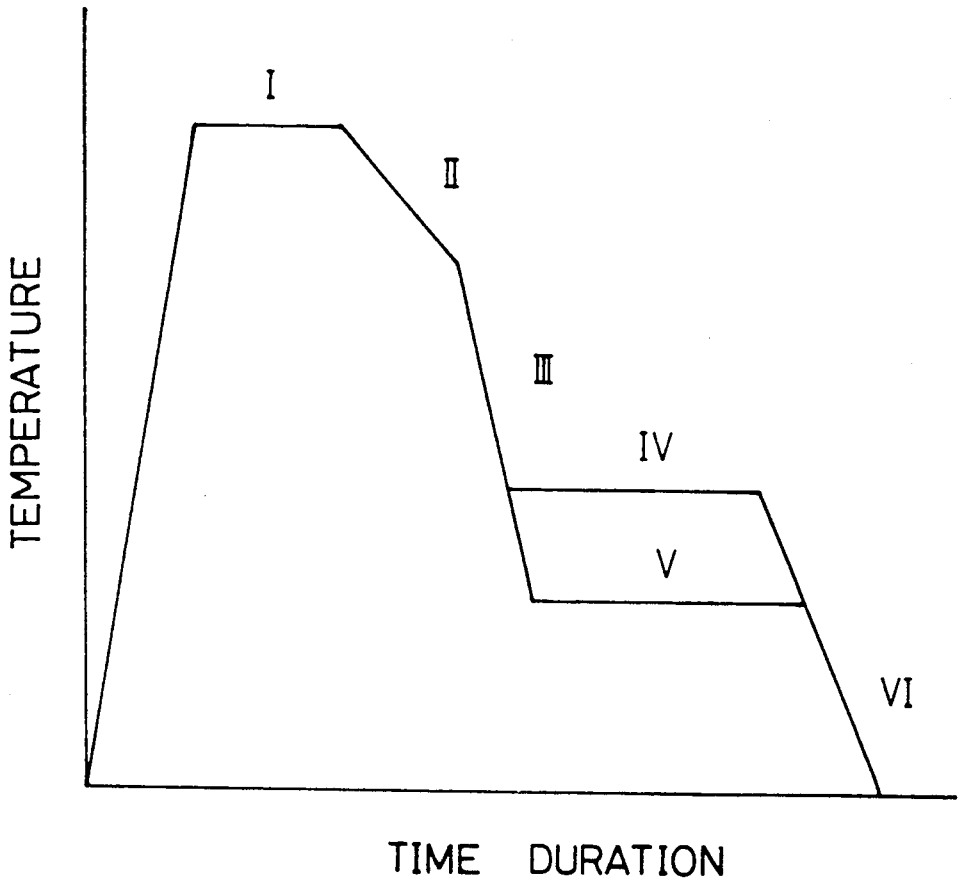
FIG. 1 is a diagram showing the relationships between temperature and time duration during heat treatment of the steel of this invention.

It is an aspect of this invention to induce the conventional concept of manufacturing the dual-phase steel into the manufacturing process of the bake hardening steel sheet and to enhance the quenching hardenability by adding boron to the steel. A small amount of boron is added into the matrix of the steel to elevate the quenching hardenability of the steel and subsequently to obtain a cold-rolled steel sheet with a ferrite plus martensite dual-phase structure after annealing. Furthermore, due to the precedency of the segregation of boron at the grain boundaries, the residual amount of the carbon solid solutions and the nitrogen solid solutions in the matrix of the steel will increase, and thus the bake hardenability of the steel will be elevated to meet the requirements of the outer panel of an automobile.

The process of manufacturing the steel sheet of this invention will be described with reference to FIG. 1. The process includes the following steps:

(1) preparing a melting steel which contains 0.02 to 0.06% carbon by weight, 0.60% to 1.40% manganese by weight, 0.5% silicon by weight at most, 0.1% phosphorus by weight at most, 0.1% aluminium by weight at most, 0.01% nitrogen by weight at most, 0.1% titanium by weight at most, and 50 ppm of boron at most;

(2) preparing steel ingots by continuous casting the melting steel;

(3) hot rolling the steel ingots to hot-rolled bands;

(4) coiling the hot-rolled bands of temperature ranging from 560° C. to 720° C.;

(5) after cold rolling, soaking the steel sheets at temperature ranging from 780° C. to 900° C. for less than five minutes to proceed intercritical (ferrite plus austenite) annealing treatment.

(6) gradually cooling the steel sheets in the air to temperature ranging from 650° C. to 750° C.; and (7) cooling the steel sheets temperature ranging from 200° C. to 400° C. by roller-quenching at the cooling rate ranging from 50° C./sec to 400° C./sec to proceed overaging treatment for a time duration ranging from 1 minute to 6 minutes.

The constituents of the steel and the conditions of treatment are strictly limited, and the following is the reasons for limitation.

REASONS FOR THE LIMITATION OF CONSTITUENTS

(1) Carbon

In order to assure that the structure of a steel can transform from a ferrite plus austenite dual-phase to a ferrite plus martensite dual-phase, the amount of carbon has to be limited to 0.02% by weight at least. If the amount of carbon is over 0.06%, a large amount of martensites will be obtained, and the tensile strength of the steel will be elevated. However, the yield strength of the steel will also be elevated, and the spring back angle will increase to damage the shape-formability of the steel sheet. Thus, it is preferable to limit the amount of carbon within 0.02%–0.06% by weight.

(2) Silicon

The silicon has the effects of deoxygenation and enhancing the strengthening effect by solid solutions. Furthermore, it will increase the amount of the carbon solid solutions to elevate the bake hardenability of the steel. However, if the amount of silicon is over 0.5% by weight, the grains of the steel will grow and the amount of the carbon solid solutions will decrease. Thus, it is preferable to limit the amount of silicon less than 0.5% by weight.

(3) Manganese

The manganese is capable of enhancing the quenching hardenability of the steel. The inventor of this invention has conducted a test concerning the relationships between the formation of martensite and the mechanical properties during dual-phase treatment of the steel. The result is shown in Table 1 and Table 2.

TABLE 1

| NO. OF TEST PIECE | CARBON | SILICON | MANGA-NESE | PHOSPHO-RUS | SULFUR | HEAT TREATMENT | REMARKS |
|---|---|---|---|---|---|---|---|
| 1 | 0.027 | 0.02 | 0.27 | 0.015 | 0.010 | SOAKING AT 800° C. FOR 2 MINUTES, THEN COOLING IN THE AIR TO 700° C., SUBSEQUENTLY ROLLER-QUENCHING TO 300° C. AT SPEED OF 400° C./SEC, THEN SOAKING AT 300° C. FOR 5 MINUTES. FINALLY COOLING IN THE AIR. | STEELS FOR COMPARISON |
| 2 | 0.030 | 0.03 | 0.45 | 0.010 | 0.010 | SOAKING AT 800° C. FOR 2 MINUTES, THEN COOLING IN THE AIR TO 700° C., SUBSEQUENTLY ROLLER-QUENCHING TO 300° C. AT SPEED OF 400° C./SEC, THEN SOAKING AT 300° C. FOR 5 MINUTES. FINALLY COOLING IN THE AIR. | |
| 3 | 0.028 | 0.02 | 0.66 | 0.012 | 0.008 | SOAKING AT 800° C. FOR 2 MINUTES, THEN COOLING IN THE AIR TO 700° C., | STEELS OF THIS INVENTION |

TABLE 1-continued

| NO. OF TEST PIECE | CARBON | SILICON | MANGA-NESE | PHOSPHO-RUS | SULFUR | HEAT TREATMENT | REMARKS |
|---|---|---|---|---|---|---|---|
| | | | | | | SUBSEQUENTLY ROLLER-QUENCHING TO 300° C. AT SPEED OF 400° C./SEC. THEN SOAKING AT 300° C. FOR 5 MINUTES. FINALLY COOLING IN THE AIR. | |
| 4 | 0.035 | 0.02 | 0.88 | 0.015 | 0.011 | SOAKING AT 800° C. FOR 2 MINUTES. THEN COOLING IN THE AIR TO 700° C., SUBSEQUENTLY ROLLER-QUENCHING TO 300° C. AT SPEED OF 400° C./SEC. THEN SOAKING AT 300° C. FOR 5 MINUTES. FINALLY COOLING IN THE AIR. | |
| 5 | 0.031 | 0.02 | 1.27 | 0.011 | 0.010 | SOAKING AT 800° C. FOR 2 MINUTES. THEN COOLING IN THE AIR TO 700° C., SUBSEQUENTLY ROLLER-QUENCHING TO 300° C. AT SPEED OF 400° C./SEC. THEN SOAKING AT 300° C. FOR 5 MINUTES. FINALLY COOLING IN THE AIR. | |

TABLE 2

| NO. OF TEST PIECE | YIELD STRENGTH (Kgf/mm²) | TENSILE STRENGTH (Kgf/mm²) | YIELD SATIO YS/TS | ELONGA-TION % | N VALUE | YIELD STRENGTH INCREASED BY WORK HARDENING (Kgf/mm²) | YIELD STRENGTH INCREASED BY BAKING HARDENING (Kgf/mm²) | MICRO-STRUC-TURE | RE-MARKS |
|---|---|---|---|---|---|---|---|---|---|
| 1 | 31.03 | 35.80 | 0.87 | 42.7 | 0.214 | — | — | F + P | STEELS |
| 2 | 30.95 | 35.90 | 0.86 | 41.23 | 0.239 | — | 0.85 | F + P + B | FOR COM-PARISON |
| 3 | 23.94 | 38.7 | 0.62 | 42.5 | 0.255 | 3.20 | 5.16 | F + M | STEELS |
| 4 | 22.82 | 39.04 | 0.58 | 41.9 | 0.264 | 3.85 | 5.77 | F + M | OF THIS |
| 5 | 20.67 | 39.81 | 0.52 | 41.0 | 0.271 | 4.25 | 6.09 | F + M | INVEN-TION |

F FERRITE P PEARITE B BAINITE M MARTENSITE

The steel under test contains approximately 0.03% carbon by weight, approximately 0.02% silicon by weight and 0.3 to 1.3% manganese by weight. The process of heat treatment according to this invention is shown in FIG. 1. Referring to Table 1 and Table 2, when the amount of manganese is 0.45% by weight, the steel is unable to transform into the ferrite plus martensite dual-phase structure, and thus the mechanical properties expected is unable to be obtained. However, when the amount of manganese is over 0.6% by weight, the quenching hardenability of the steel is obviously enhanced, and the steel is capable of transforming into the ferrite plus martensite dual-phase structure which is in conformity to the mechanical properties of the steel of this invention. In addition, too much manganese will impair the weldability of the steel. Thus, it is preferable to limit the amount of manganese within 0.6 to 1.4% by weight.

(4) Phosphorus

Adding phosphorus into the steel will improve the percipation of solid solutions and the shape-forming workability of the steel, such as deep drawing. Furthermore, phosphorus will increase the amount of carbon solid solutions. However, the segregation of phosphorus at grain boundaries will increase the brittleness of the steel. Furthermore, if the amount of phosohorus is over 0.1% by weight, the weldability of the steel will be impaired. Thus, it is preferable to limit the amount of phosphorus below 0.1% by weight.

(5) Boron

Figure 2:
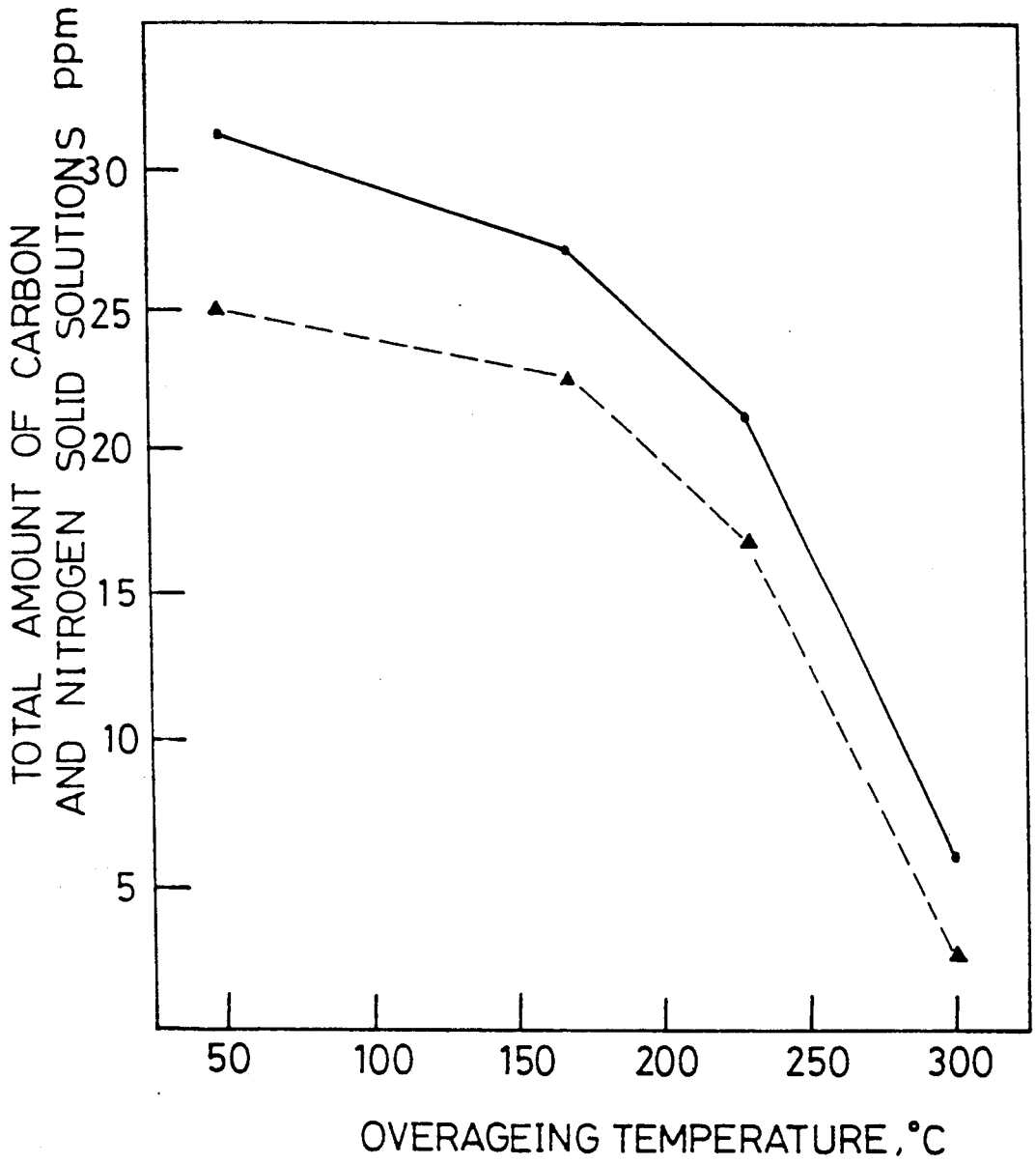
FIG. 2 is a diagram showing the influence on the total amount of soluble carbon and soluble nitrogen when boron is added into the matrix of the steel.

Small amounts of boron will enhance the quenching hardenability of the steel. Furthermore, due to the precedency of the segregation of boron at grain boundaries, the brittleness of the steel induced by over-adding of the phosphorus will be avoided. In addition, the amount of carbon solid solutions and nitrogen solid solutions will be increased, and the baking hardenability of the steel will be enhanced. FIG. 2 shows the influence on the total amount of carbon and nitrogen when the boron is added into the matrix of the steel. As shown in FIG. 2, the total amount of carbon and nitrogen is increased after adding of boron. However, when the amount of boron is over 50 ppm, no further advantage is found. Thus, it is preferable to limit the amount of boron below 50 ppm.

(6) Nitrogen

Adding nitrogen into the matrix of the steel will enhance the precipation of solid solutions and enhance the baking hardenability of the steel. However, too much nigrogen will induce the phenomenon of room temperature ageing of the steel, which will cause the change of the mechanical properties of the steel and the restoration of the yield point elongation of the steel. Thus, it is preferable to limit the amount of nitrogen below 0.01% be weight.

(7) Titanium

Boron is apt to react with oxygen and nitrogen to form compounds which will damage the promoting effect of quenching hardenability and bake hardenability of the steel by added boron element. For this reason, in order to reinforce the effect of adding boron, a small amount of titanium is necessary. The amount of titanium is limited by the following formula:

$$(N - 14/48\ ti) < 40 \text{ ppm.}$$

Where N and Ti respectively stand for the amount of nitrogen and titanium. The above formula means that the amount of free nitrogen is limited below 40 ppm.

The process of continuous annealing are shown in FIG. 1, the following is the reasons for limiting the conditions of the process.

(1) Annealing Conditions

In order to have required amount of austenite in the matrix to obtain a dual-phase structure steel whose mechanical properties are in conformity with the steel of this invention, it is preferable to keep annealing temperature at above 780° C. If annealing temperature is elevated during this stage, the grains of austenite will grow, and the quenching hardenability of the steel will be enhanced to obtain a martensite phase. For boron added steels, the elevation of the annealing temperature will enhance the quenching hardenability and the baking hardenability of the steels. Table 4 shows the relationships between various treatment temperatures and the mechanical properties of the steel containing constituents listed in Table 3.

TABLE 3

| NO. OF TEST PIECE | CARBON | SILICON | MANGANESE | PHOSPHORUS | SULFUR | ALUMINIUM | NITROGEN | BORON | TITANIUM |
|---|---|---|---|---|---|---|---|---|---|
| 6 | 0.028 | 0.03 | 0.78 | 0.03 | 0.010 | 0.05 | 0.0070 | 0.0035 | 0.012 |

TABLE 4

| NO. OF TEST PIECE | UNIFROM TEMPERATURE (°C.) | YIELD STRENGTH (Kgf/mm²) | TENSILE STRENGTH (Kgf/mm²) | ELONGATION % | YIELD STRENGTH INCREASED BY WORK HARDENING (Kgf/mm²) | YIELD STRENGTH INCREASED BY BAKING HARDENING (Kgf/mm²) | HEAT TREATMENT |
|---|---|---|---|---|---|---|---|
| 6 | 740 | 33.42 | 38.22 | 41.3 | 0.20 | 0.33 | SOAKING AT UNIFROM TEMPERATURE FOR 2 MINUTES; THEN COOLING TO 720° C., SUBSEQUENTLY ROLLER-QUENCHING TO 350° C. AT SPEED OF 100° C./SEC, THEN SOAKING AT 350° C. FOR 5 MINUTES. FINALLY COOLING IN THE AIR TO ROOM TEMPERATURE |
| | 770 | 30.81 | 39.07 | 42.0 | 1.24 | 2.66 | |
| | 800 | 23.90 | 40.40 | 40.5 | 3.15 | 4.07 | |
| | 850 | 22.60 | 39.61 | 39.6 | 3.62 | 5.04 | |
| | 870 | 22.20 | 40.38 | 37.2 | 5.40 | 5.45 | |
| | 890 | 21.31 | 39.30 | 38.3 | 6.78 | 4.20 | |

(8) Aluminium

Aluminium is used for deoxygenation of the steel. If the amount of aluminium us over 0.1% by weight, the surface flatness will be impaired. Thus, it is preferable to limit the amount of aluminium below 0.1% by weight.

REASONS FOR THE LIMITATION OF THE CONDITIONS OF TREAMENTS

The coiling temperature is an important factor for the process of this invention. Due to the short time duration of the continuous annealing process, the atoms of carbon and manganese are unable to reach their equilibrium concentrations by diffusion process. If the coiling is proceeded at temperature higher than 560° C., a coarsen cementite structure with rich carbon and manganese content will be obtained, which will easily transform into austenite during intercritical annealing. Furthermore, the large amount of carbon and manganese in the transformed austenite phase will enhance the quenching hardenability of the steel, and thus ferrite plus martensite dual-phase structure is able to be obtained.

Figure 3:
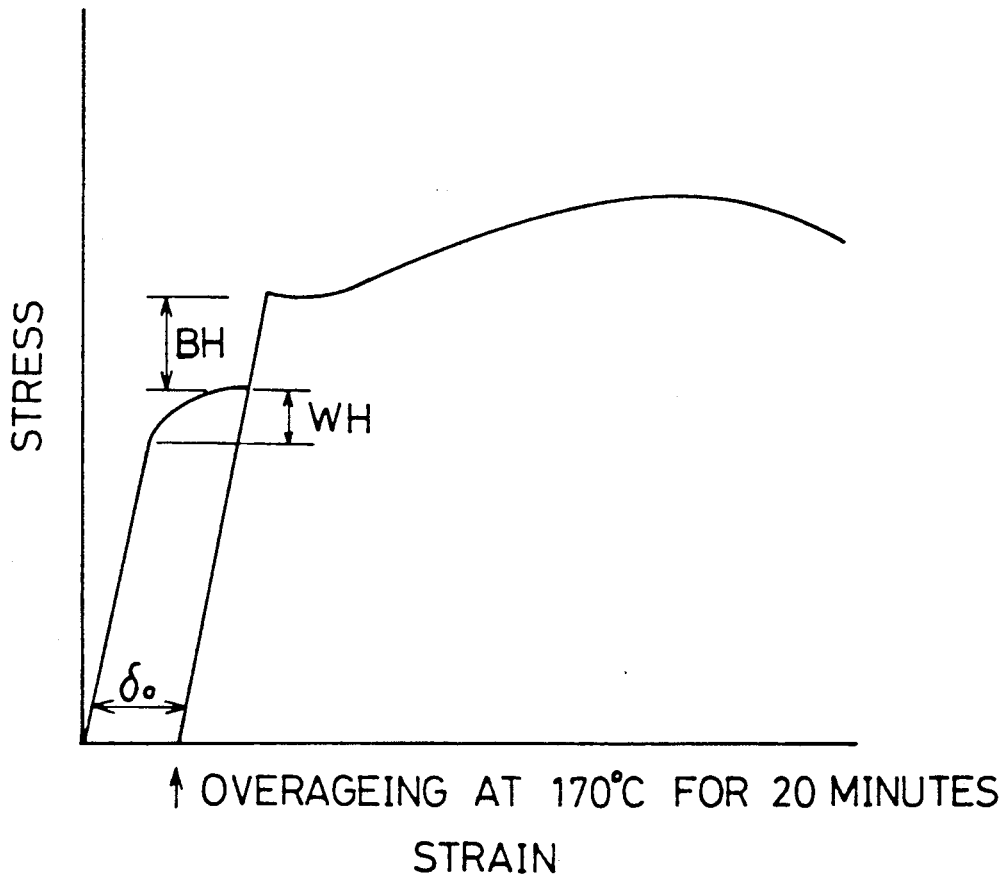
FIG. 3 is a diagram showing a method for evaluating the work hardenability and the bake hardenability of the steel.

FIG. 3 shows a method for evaluating the work hardenability and the bake hardenability of the steel. Furthermore, it is preferable to limit the time duration for treating at uniform temperatures within five minutes so as to promote the productivity of the steels.

(2) Quenching Temperatures

The steel sheets are gradually cooled down to 650° C.-700° C. and subsequently roller-quenched to 200° C.-400° C. to proceed overageing treatment. Table 5 shows the relationships between various quenching temperatures and the mechanical properties of the steel. When quenching temperature is below 650° C., due to the fact that the cooling curve of austenite will go across the nose of the pearlite transformation region, the ferrite plus martensite dual-phase structure is unable to be obtained. If quenching temperature is above 750° C., the quenching hardenability of the steel will get worse, and the ferrite plus martensite dual-phase structure is unable to be obtained either. If is to be noted that the cooling rate of roller-quenching is preferably kept at a range from 50° C./sec to 400° C./sec.

TABLE 5

| NO. OF TEST PIECE | QUENCHING TEMPERATURE (°C.) | YIELD STRENGTH | TENSILE STRENGTH | YIELD RATIO | ELONGATION | MICRO-STRUCTURE | HEAT TREATMENT |
|---|---|---|---|---|---|---|---|
| 6 | 600 | 27.1 | 37.35 | 0.73 | 43.2 | F + P | SOAKING AT 850° C. FOR 5 MINUTES, THEN COOLING IN THE AIR TO QUENCHING TEMPERATURE. SUBSEQUENTLY ROLLER-QUENCHING TO 250° C. AT SPEED OF 400° C./SEC, THEN SOAKING AT 250° C. FOR 5 MINUTES. FINALLY COOLING IN THE AIR TO ROOM TEMPERATURE |
| | 650 | 23.46 | 38.91 | 0.60 | 40.1 | F + M | |
| | 700 | 22.80 | 39.74 | 0.57 | 39.4 | F + M | |
| | 750 | 24.07 | 39.96 | 0.60 | 37.2 | F + M | |
| | 800 | 28.32 | 39.42 | 0.72 | 34.9 | F + B | |

(3) Overageing Conditions

Figure 4:
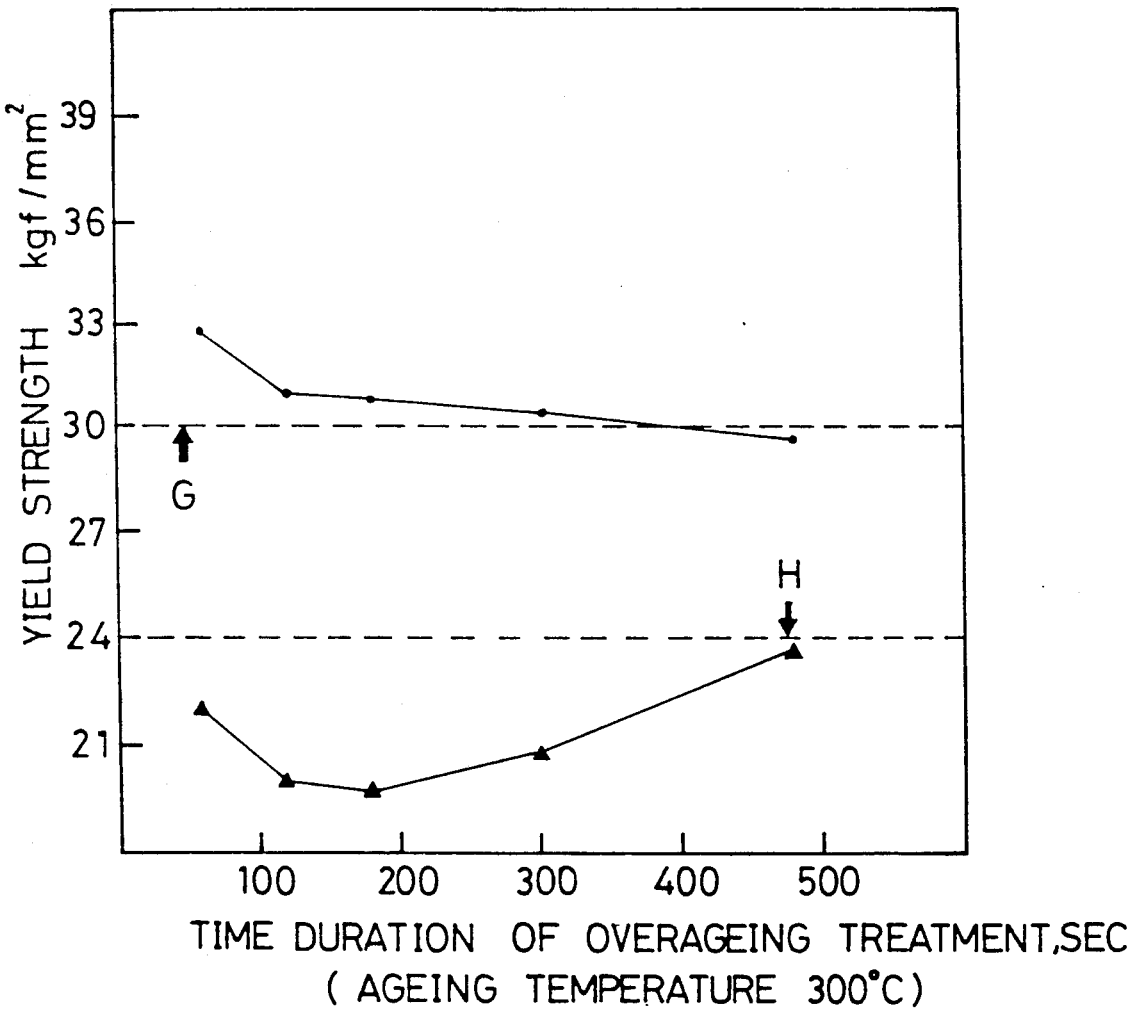
FIG. 4 is a diagram showing how the time duration of overageing effects the yield strength of the steel.
Figure 5:
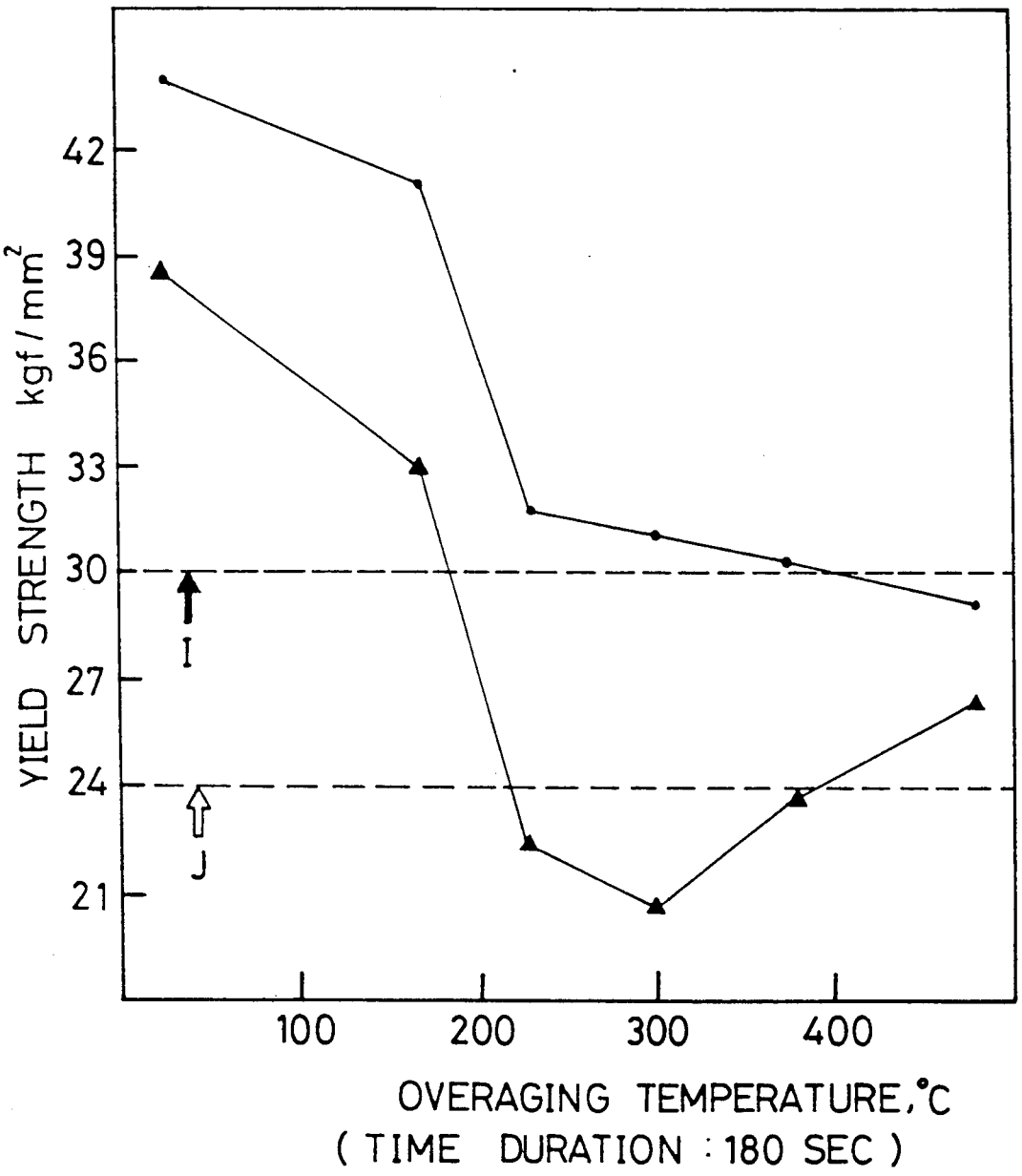
FIG. 5 is a diagram showing how the overageing temperature affects the yield strength of the steel.

The purpose of overageing is to urge the carbon solid solutions in the matrix of the steel to proceed a super saturated precipation and to leave a proper amount of carbon solid solutions. By this, the yield ratio of the dual-phase steel will decrease, and the workability will be improved. At the same time, the bake hardenability of the steel is properly kept. FIG. 5 shows how the overageing temperature affects the yield strength of the steel. As shown in FIG. 5, the yield strength of the steel will decrease in response to the elevation of the ageing temperature. If the ageing temperature is too high, due to the dullness of the super saturated precipation of solid solutions and the tempering of martensite, the yield strength of the steel will be elevated again. Thus, it is preferable to keep the ageing temperature within 200° C.–400° C. FIG. 4 shows how the time duration of overageing affects the yield strength of the steel. As shown in FIG. 4, if the time duration of overageing is too large, due to the reduction of the amount of carbon solid solutions, one is unable to obtain a cold-rolled steel sheet of this invention, which has yield strength below 24 kgf/mm$^2$ before shape-forming and over 30 kgf/mm$^2$ after shape-forming and baking finish.

Table 6 shows the constituents and the heat treatment process of various steels. Table 7 shows the mechanical properties and microstructure of the steels listed in Table 6. Test pieces No. 7 and No. 8 are steels of this invention, both of which have ferrite plus martensite dual-phase structures. The tensile strengths of test pieces No. 7 and No. 8 are approximately 40 Kgf/mm$^2$, and the elongations are higher than 40%. Furthermore, the yield strengths of test pieces No. 7 and No. 8 are lower than 24 kgf/mm$^2$, and both of them are elevated to a level higher than 30 kgf/mm$^2$ after shape-forming and baking finish. Test piece No. 9 has constituents similar to those of test pieces No. 7 and No. 8 except manganese. For lack of maganese, a ferrite plus martensite dual-phase structure is unable to be obtained by continuous annealing test piece No. 9. Furthermore, the yield strength of test piece No. 9 is too high, and the work hardenability and the bake hardenability of test piece No. 9 are poor. The constituents and treatment process of test piece No. 10 are not in conformity to this invention, but it is capable of obtaining a steel sheet having similar mechanical properties to those of the steel sheets of this invention. However, the amount of carbon of test piece No. 10 is 0.009, thus it will cost much to reduce the amount of carbon to such a low level. Furthermore, the heat treatment of test piece No. 10 is box annealing which is time-consumption. The constituents of test pieces No. 11 and No. 12 are in conformity to those of the steels according to this invention except manganese. For lack of manganese, test pieces No. 11 has to be water-quenched to obtain a ferrite plus martensite structure. However, it should be water-quenched to room temperature and subsequently reheated to proceed overageing. Thus, it is a waste of energy. Furthermore, the quenching stress in test piece No. 11 is higher than that of other test pieces, and the flatness of the steel sheet will be impaired. The yield ratio and the rate of the work hardenability (n value) of test piece No. 11 is inferior to those of the steels according to this invention.

While the invention has been described in terms of what is presently considered to be the most practical and preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

TABLE 6

| NO. OF TEST PIECE | CARBON | SILICON | MANGANESE | PHOSPHORUS | SULFUR | ALUMINIUM | NITROGEN | OTHERS | HEAT TREATMENT | REMARKS |
|---|---|---|---|---|---|---|---|---|---|---|
| 7 | 0.04 | 0.03 | 1.1 | 0.018 | 0.018 | 0.060 | 0.0070 | — | CONTINUOUS ANNEALING BY ROLLER-QUENCHING AT SPEED OF 50–400° C. SEC | STEELS OF THIS INVENTION |
| 8 | 0.03 | 0.03 | 0.72 | 0.012 | 0.010 | 0.050 | 0.0063 | BORON: 0.0022 TITANIUM: 0.015 | CONTINUOUS ANNEALING BY ROLLER-QUENCHING AT SPEED OF 50–400° C. | |

TABLE 6-continued

| NO. OF TEST PIECE | CARBON | SILICON | MANGANESE | PHOSPHORUS | SULFUR | ALUMINUM | NITROGEN | OTHERS | HEAT TREATMENT | REMARKS |
|---|---|---|---|---|---|---|---|---|---|---|
| 9 | 0.03 | 0.02 | 0.5 | 0.010 | 0.015 | 0.058 | 0.0065 | — | SEC CONTINUOUS ANNEALING BY ROLLER-QUENCHING AT SPEED OF 50–400° C. SEC | STEELS FOR COMPARISON |
| 10 | 0.009 | 0.06 | 0.14 | 0.046 | — | 0.051 | 0.0055 | — | BOX-ANNEALING AT SPEED OF 10° C./hr | |
| 11 | 0.03 | 0.01 | 0.16 | 0.010 | 0.015 | 0.046 | 0.0048 | — | WATER-QUENCHING AT SPEED OF 1000° C./SEC | |
| 12 | 0.05 | 0.02 | 0.23 | 0.015 | — | — | — | — | WATER-QUENCHING AT SPEED OF 1000° C./SEC | |

TABLE 7

| NO. OF TEST PIECE | YIELD STRENGTH (Kgf/mm²) | TENSILE STRENGTH (Kgf/mm²) | ELONGATION % | N VALUE | YIELD STRENGTH INCREASED BY WORK HARDENING (Kgf/mm²) | YIELD STRENGTH INCREASED BY BAKING HARDENING (Kgf/mm²) | MICRO-STRUCTURE | REMARKS |
|---|---|---|---|---|---|---|---|---|
| 7 | 21.3 | 40.2 | 41.1 | 0.268 | 4.7 | 4.8 | F + M | STEELS |
| 8 | 22.8 | 39.7 | 40.8 | 0.233 | 3.6 | 6.1 | F + M | OF THIS INVENTION |
| 9 | 29.2 | 35.7 | 42.0 | 0.220 | 0.5 | 0.7 | F + P + B | STEELS FOR |
| 10 | 20.0 | 35.2 | 39.6 | 0.230 | 4.7 | 3.9 | F + P | COMPARISON |
| 11 | 23.5 | 35.6 | 43.9 | 0.198 | 3.5 | 4.0 | F + M | |
| 12 | 27.3 | 40.2 | 40.2 | 0.203 | — | 4.0 | F + M | |

What is claimed is:

1. A process for manufacturing bake hardening, cold-rolled steel sheets, comprising the following steps:

(1) preparing a steel melt consisting essentially of 0.02 to 0.06% carbon by weight, 0.60 to 1.40% manganese by weight, 0.5% or less silicon by weight, 0.1% or less phosphorus by weight, 0.1% or less aluminum by weight, 0.01% or less nitrogen by weight, 0.1% or less titanium by weight, and 50 ppm or less boron;

(2) preparing steel ingots by continuous casting the steel melt;

(3) hot rolling the steel ingots into hot-rolled bands;

(4) coiling the hot-rolled bands at a temperature ranging from 560° C. to 720° C.;

(5) after cold-rolling, forming steel sheets from said hot-rolled bands and soaking the steel sheets at a temperature ranging from 780° C. to 900° C. for less than five minutes to effect an intercritical ferrite plus austenite dual-phase structure by annealing treatment;

(6) gradually cooling the steel sheets in air to a temperature ranging form 650° C. to 750° C.; and (7) cooling the steel sheets to a temperature ranging from 200° C. to 400° C. by roller-quenching at a cooling rate ranging from 50° C./sec to 400° C./sec to effect overageing treatment for a time duration ranging from 1 minute to 6 minutes and thereby transforming the ferrite plus austenite dual-phase structure to a ferrite and martensite dual-phase structure having improved bake hardening without comprising a room temperature aging resistance of the steel.

2. A bake hardening cold-rolled steel sheet manufactured by the following steps;

(1) preparing a steel melt consisting essentially of 0.02 to 0.06% carbon by weight, 0.06 to 1.40% manganese by weight, 0.5% or less silicon by weight, 0.1% or less phosphorus by weight, 0.1% or less aluminum by weight, 0.01% or less nitrogen by weight, 0.1% or less titanium by weight, and 50 ppm or less of boron;

(2) preparing a steel ingot by continuously casting the steel melt;

(3) hot rolling the steel ingot into a hot-rolled band;

(4) coiling the hot-rolled band at a temperature ranging from 560° C. to 720° C.;

(5) after cold rolling, forming a steel sheet from said hot-rolled band and soaking the steel sheet at a temperature ranging from 780° C. to 900° C. for less than five minutes to effect an intercritical ferrite plus austenite dual-phase structure by annealing treatment;

(6) gradually cooling the steel sheet in air to a temperature ranging from 650° C. to 750° C.; and (7) cooling the steel sheet to a temperature ranging from 200° C. to 400° C. by roller-quenching at a cooling rate ranging from 50° C./sec to 400° C./sec to effect overageing treatment for a time duration ranging from 1 minute to 6 minutes thereby effecting a transformation of the ferrite plus austenite dual-phase structure to a ferrite and martensite dual-phase structure having improved bake hardening without comprising a room temperature aging resistance of the steel.

* * * * *